United States Patent [19]

Tolle

[11] 4,171,842

[45] Oct. 23, 1979

[54] J-HOOK

[75] Inventor: Russell W. Tolle, Chanute, Kans.

[73] Assignee: Tolle Manufacturing Co., Inc., Chanute, Kans.

[21] Appl. No.: 872,758

[22] Filed: Jan. 27, 1978

[51] Int. Cl.[2] ..... B66C 1/34

[52] U.S. Cl. ..... 294/82 R; 414/563

[58] Field of Search ..... 294/82 R, 82 AH, 81 R, 294/83 R; 214/86 A, 86 R; 24/230.5 R, 73 CE, 73 HH

[56] References Cited

U.S. PATENT DOCUMENTS

| | | | |
|---|---|---|---|
| 595,181 | 12/1897 | Langan | 24/230.5 R |
| 1,517,019 | 11/1924 | Serl | 294/82 R |
| 2,913,131 | 11/1959 | Holmes | 214/86 A |

*Primary Examiner*—James B. Marbert

*Attorney, Agent, or Firm*—Fishburn, Gold & Litman

[57] ABSTRACT

A thickened elbow section is included between the shank and the curved tip of a J-hook to provide greater strength for the lifting and pulling of objects. Accordingly, the hook has a J-shaped front edge, an L-shaped rear edge, and can be produced by forging hot rolled carbon steel. The yield point and tensile strength is substantially greater than exhibited by conventional J-hooks produced by the bending and heat treating of bar stock.

11 Claims, 7 Drawing Figures

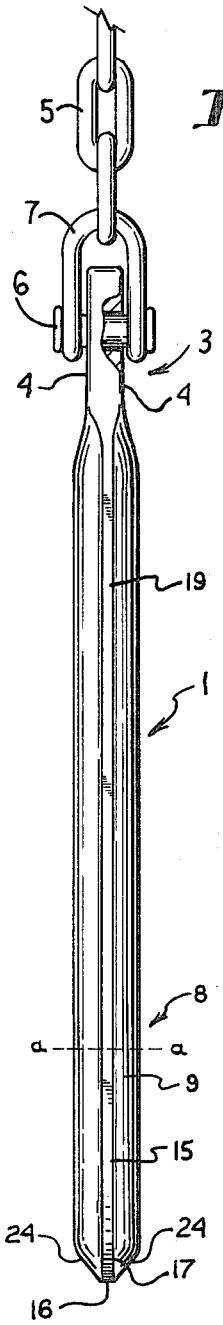
Fig. 5.
Fig. 6.
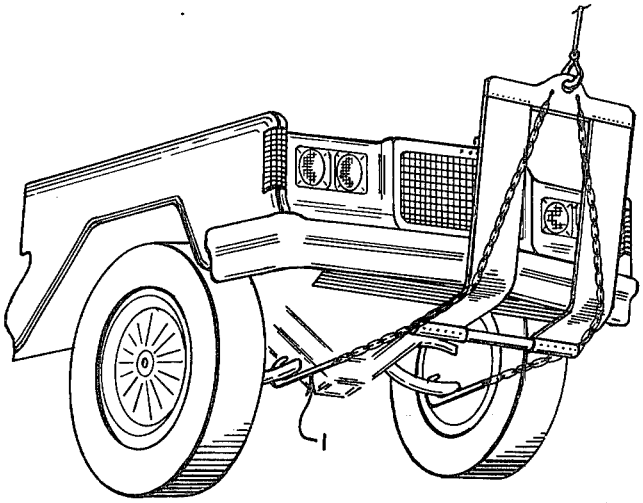
Fig. 7.
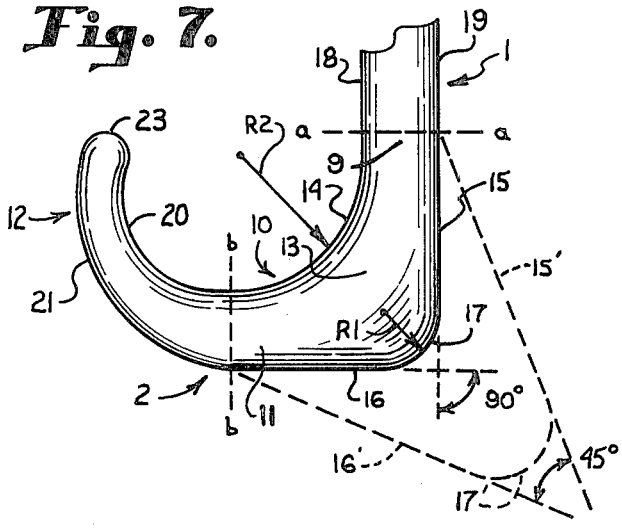

J-HOOK

BACKGROUND OF THE INVENTION

This invention pertains to metal hooks that are used in the towing or lifting of weighty objects, and more particularly pertains to a J-hook having a novel shape whereby the strength thereof is substantially increased.

Typical J-hooks are made from steel, have an elongated shank with an upturned tip at one end, and have a span between the shank and the tip of about 2–4 times the diameter of the shank. Such hooks are used at the end of a wenched chain or cable for attachment of heavy items such as automobiles, trucks, busses, machinery, or the like, that must be elevated and/or moved to another location. The wide span between the shank and the tip of the hook facilitates attachment thereof to relatively thick and strong structural members on an item to be lifted or towed, thereby preventing damage to the item while at the same time assuring secure attachment thereof by means of the hook.

Prior J-hooks have been produced by turning down one end of a length of bar stock, bending the turned down end to provide an upturned tip, and heat treating the hook thus formed to increase the strength thereof. When intended for the towing of automobiles, exemplary J-hooks produced in accordance with the prior art are made up from $\frac{5}{8}$ to $\frac{3}{4}$ inch bar stock, have a length of 10–12 inches, and exhibit a yield strength on the order of 7,000 pounds.

SUMMARY OF THE INVENTION

One object of the present invention is to provide a redesigned J-hook characterized by increased strength.

Another object is to provide a stronger, safer, and more durable J-hook.

Other objects and advantages of the invention will become apparent from the following description, the drawings, and the appended claims.

The present invention is a J-hook having a J-shaped front edge and an L-shaped rear edge and comprises solid, integral shank and crooked portions, and wherein said crooked portion includes a curved upper edge, a rear edge that extends downwardly in a divergent relation to the curved upper edge, and a lower edge portion that extends rearwardly in a divergent relation to the curved upper edge and joins with the rear edge portion. Accordingly, the body of the hook is substantially thickneed between the shank and the upturned tip portion thereof, thereby reducing its tendency to bend or break when supporting a heavy load.

BRIEF DESCRIPTION OF THE DRAWINGS

FIG. 5 is a rear view of the J-hook shown in FIG. 1.

FIG. 6 shows use of the present J-hook in the towing of an automobile.

FIG. 7 is a somewhat diagrammatic representation of the lower end of the J-hook shown in FIG. 1.

DESCRIPTION OF PREFERRED AND ALTERNATIVE EMBODIMENTS

Figure 1:
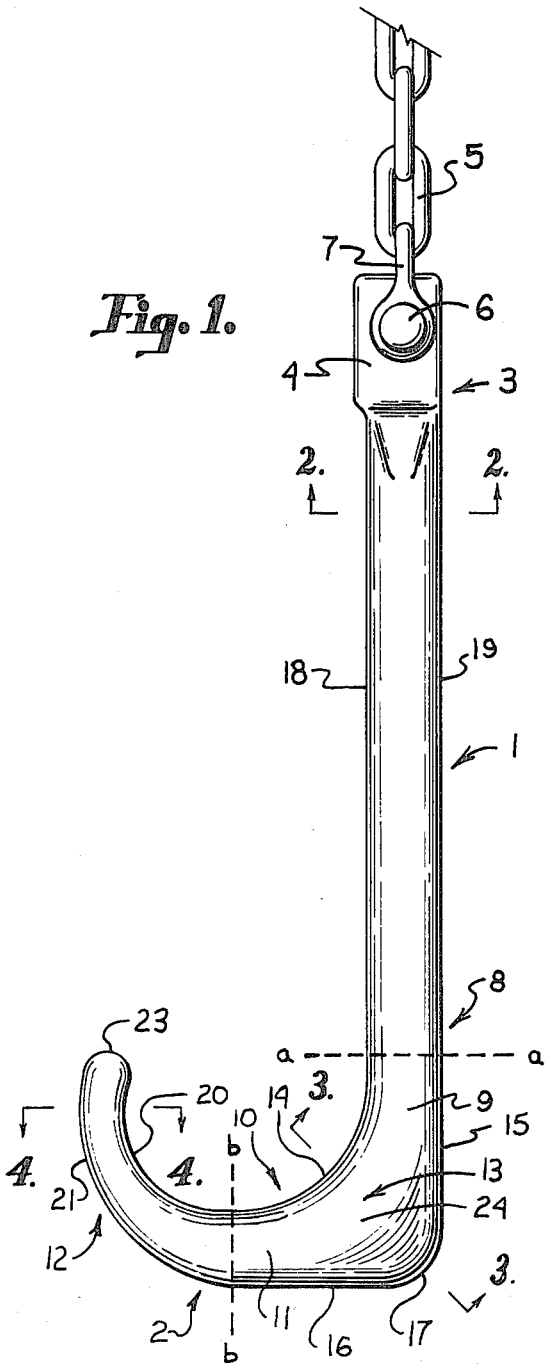
FIG. 1 is a side view of a J-hook constructed in accordance with the present invention.

The terms "upper", "lower", "front", "rear", "forward", "rearward" and derivatives thereof as are used herein for describing portions of a J-hook are intended to be applicable to any J-hook that is oriented as shown in the drawings.

In FIG. 1, the body of the J-hook comprises a solid, integral body that includes a shank portion 1 and a crooked portion 2. The upper end 3 of the shank portion has flat surfaces 4 on each side for attachment of a chain 5 thereto by means of a pin 6 and clevis 7. The lower end 8 of the shank merges axially with the upper end 9 of an elbow portion 10 of the crooked portion, and the lower end 11 of the elbow portion merges with an upwardly curved tip portion 12 of the crooked portion. The upper and lower ends of the elbow are demarkated in FIGS. 1 and 7 by broken lines 'a' and 'b', respectively.

As can be seen in the drawings, the elbow portion 10 is substantially deeper, or thicker, in the bend 13 thereof than at the ends 9 and 11, and has a curved upper edge 14, a rear edge 15 that extends downwardly in a divergent relation to the upper edge 14, and a lower edge portion 16 that extends rearwardly in a divergent relation to the upper edge 14. In the embodiment illustrated in the drawings, the rear edge 15 and the lower edge portion 16 are joined by a curved lower edge 17 having a shorter radius than the curved upper edge 14, and the rear edge and the lower edge extend toward each other at an angle of about 90° and merge with the curved lower edge. To advantage, the rear edge 15 and lower edge portion 16 extend toward each other at an angle of no more than about 90°, inclusive, and preferably at an angle within the range of about 90°–45°, inclusive.

In FIG. 7, the shorter radius of the curved lower surface 17 is represented at R1, whereas the longer radius of the curved upper surface 14 is represented at R2. Also, in FIG. 7, the extension of rear edge 15 and lower edge portion 16 toward each other at an included angle of 45° is represented by the broken lines 15' and 16'. In the illustrated embodiments, the rear edge and lower edge portions are straight, but can be somewhat curved if preferred. Although the shank 1 of the hook can be tapered lengthwise, the front edge 18 and the rear edge 19 are preferably parallel, straight, and unbroken along their length, with the front and rear edges of the shank merging with the curved upper edge and the rear edge, respectively, of the elbow portion 10.

The crooked portion 2 of the J-hook shown in the drawings further includes a tip portion 12 that merges with the lower end 11 of the elbow portion 10 and extends forwardly and upwardly therefrom. The tip portion has an upper curved edge 20 thereon that merges with the curved upper edge 14 on the elbow portion, and a lower curved edge 21 thereon that merges with the lower edge portion 16 on the elbow portion. These upper and lower curved edges of the tip curve forwardly and upwardly in a convergent relation to each other and merge with the rounded end 23 of the tip.

Figure 2:
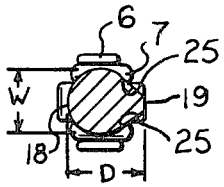
FIGS. 2, 3 and 4 are cross-sectional view of the J-hook along lines 2, 3 and 4 of FIG. 1, respectively.
Figure 3:
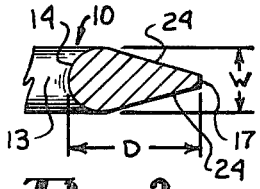
Figure 4:
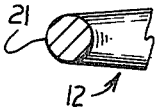

By reference to the drawings, it can be seen that front and upper edge portions 18, 14 and 20 merge together to provide the hook with a J-shaped front edge, whereas an L-shaped rear edge is provided by rear and lower edge portions 16, 17 and 19. As a consequence, the elbow portion 10 has greater depth than width, and with the depth being substantially greater at the bend of the elbow portion than toward the ends thereon. (Width and depth dimensions are represented by lines 'W' and 'D', respectively, in FIGS. 2 and 3.) Preferably, the width of the elbow portion in the bend is at least about twice as great as at upper end thereof. As opposed to J-hooks having a J-shaped edge on both the front and the rear, the present configuration provides far greater resistance to bending or breaking when lifting heavy loads.

To facilitate forging of the hook and to reduce weight, the lower rear of the elbow portion can be tapered whereby the side surfaces 24 lead convergingly to the rear edge 15 and the lower edge portion 16. Additionally, the shank portion 1 can have a rear edge such as 19 that extends downwardly and merges with the rear edge 15, with the shank portion having a depth greater than its width and including side surfaces 25 thereon that lead convergingly to the rear edge 19 on the shank portion and join with the side surfaces 24 on the elbow portion. As shown in the drawings, the shank and elbow portions can thus be provided with an enlarged depth and also with smoothly merging edge and side portions for lending strength to the hook in areas where it is needed the most for resisting bending and breaking.

The present J-hook can be forged from conventional A.I.S.I. Standard Alloy Steels, preferably of a hot rolled variety. A satisfactory alloy is A.I.S.I. 4140 hot rolled steel. A J-hooked forged therefrom in accordance with the configuration shown in the drawings and having a shank width of $\frac{7}{8}$ inch, a shank depth of 1 1/32 inches, and a depth in the elbow portion of 2 inches can have a yield strength and a tensile strength on the order of 62,000 P.S.I. and 89,000 P.S.I., respectively. Such properties provide a strength which exceeds that of chain of a size that would normally be attached to the hook, and it is thus not inclined to bend at loads significantly below the breaking point of the chain. The strength exhibited by the present hook is, therefore, a substantial improvement over prior J-hooks which are made from heat treated bar stock and exhibit a yield strength of only about 7,000 P.S.I.

An improved J-hook that fulfills the previously stated objects has now been disclosed in detail, and although the invention has been described with reference to specific embodiments thereof, it will nonetheless be understood that even other embodiments will become apparent that are within the spirit and scope of the invention defined in the following claims.

What is claimed and desired to secure by Letters Patent is:

1. A J-hook having a J-shaped front edge and an L-shaped rear edge, said hook comprising a solid, integral body that includes shank and crooked portions, said crooked portion having an elbow portion that merges axially with said shank portion, and wherein said elbow portion includes:

(a) a curved upper edge, (b) a rear edge that extends downwardly in a divergent relation to said curved upper edge, and (c) a lower edge portion that extends rearwardly in a divergent relation to said curved upper edge and joins said rear edge; and wherein (d) said elbow portion has a depth greater than its width, and with the depth being substantially greater at the bend of the elbow portion than toward the ends thereof.

2. A J-hook as in claim 1 wherein said elbow portion has side surfaces that lead convergingly to said rear edge and said lower edge portion thereon.

3. A J-hook as in claim 1 wherein said elbow has upper and lower curved edges, said lower curved edge has a shorter radius than said upper curved edge, and said lower curved edge joins with said rear edge and said lower edge portion.

4. A J-hook as in claim 2 wherein said shank portion of the hook has a rear edge that extends downwardly and merges with said rear edge on the elbow portion, said shank portion has a depth greater than its width and includes side surfaces thereon that lead convergingly to said rear edge, and said side surfaces on the shank portion merge with those on said elbow portion.

5. A J-hook having a J-shaped front edge and an L-shaped rear edge, said hook comprising a solid, integral body that includes shank and crooked portions, said crooked portion having an elbow portion that merges axially with said shank portion, and wherein said elbow portion includes:

(a) a curved upper edge, (b) a rear edge that extends downwardly in a divergent relation to said curved upper edge, (c) a lower edge portion that extends rearwardly in a divergent relation to said curved upper edge and joins said rear edge, and (d) a tip portion that merges with said lower end of the elbow portion and extends forwardly and upwardly therefrom; said tip portion including an upper end that is spaced away from said shank portion at a distance which substantially exceeds the depth of the shank portion.

6. A J-hook as in claim 5 wherein said upper end is spaced away from said shank portion at a distance of at least about three times the depth of the shank portion.

7. A J-hook comprising a solid, integral body that includes shank, elbow and tip portion, said elbow portion having an upper end that joins with said shank portion, a lower end that joins with said tip portion, and a bend intermediate said ends, and wherein said elbow portion has a depth in said bend that is greater than the width of the bend and the depth of the elbow portion in said bend is at least about twice as great as at the upper end of the elbow.

8. A J-hook as in claim 7 wherein said elbow portion has a rear edge and a lower edge portion which join, said elbow portion having side surfaces that lead convergingly to said elbow portion rear edge and lower edge portion.

9. A J-hook as in claim 8 wherein said shank portion of the hook has a rear edge that extends downwardly and merges with said elbow portion rear edge, said shank portion has a depth greater than its width and includes side surfaces thereon that lead convergingly to said rear edge, and said shank portion side surfaces merge with said elbow portion side surfaces.

10. A J-hook as in claim 8 wherein said lower edge portion and said rear edge are substantially straight and extend toward each other at an angle within the range from about 45° to about 90°.

11. A J-hook as in claim 10 wherein said elbow portion includes an upper curved edge and said top portion includes an upper end that is spaced away from said shank portion at a distance which is substantially greater than the depth of said shank portion.

* * * * *